US009669422B2

(12) United States Patent
Koyava

(10) Patent No.: US 9,669,422 B2
(45) Date of Patent: Jun. 6, 2017

(54) APPARATUS FOR APPLYING A COATING TO THE SURFACE OF CYLINDRICAL ARTICLES

(71) Applicant: Otari Vladimirovich Koyava, St. Petersburg (RU)

(72) Inventor: Otari Vladimirovich Koyava, St. Petersburg (RU)

( * ) Notice: Subject to any disclaimer, the term of this patent is extended or adjusted under 35 U.S.C. 154(b) by 0 days.

(21) Appl. No.: 14/361,016

(22) PCT Filed: Nov. 2, 2012

(86) PCT No.: PCT/RU2012/000902
§ 371 (c)(1),
(2) Date: May 28, 2014

(87) PCT Pub. No.: WO2013/100806
PCT Pub. Date: Jul. 4, 2013

(65) Prior Publication Data

US 2014/0261165 A1 Sep. 18, 2014

(30) Foreign Application Priority Data

Dec. 27, 2011 (RU) ..... 2011153055

(51) Int. Cl.
*B05C 1/08* (2006.01)
*B05B 13/04* (2006.01)
(Continued)

(52) U.S. Cl.
CPC ..... *B05C 1/0821* (2013.01); *B05B 13/0436* (2013.01); *B05C 1/10* (2013.01);
(Continued)

(58) Field of Classification Search
CPC ..... B05B 13/0436; B05B 13/0442; B05B 13/0463; B05C 1/0821; B05C 5/0241; B05C 1/10; Y10S 118/11; Y10S 118/13
(Continued)

(56) References Cited

U.S. PATENT DOCUMENTS 3,638,600 A * 2/1972 Modrey ..... B05C 1/00 114/222
3,689,311 A * 9/1972 Loeffler ..... B05D 7/146 118/313

FOREIGN PATENT DOCUMENTS

RU 2182853 * 5/2002
SU 902851 * 2/1982
SU 1321479 * 7/1987

* cited by examiner

*Primary Examiner* — Laura Edwards
(74) *Attorney, Agent, or Firm* — Vera Chernobylsky

(57) ABSTRACT

The invention relates to apparatuses for treating the outside surface of cylindrical articles, and can be used for applying liquid substances to the surface of such articles. The apparatus for applying a coating additionally comprises a roller rotation actuator, a carriage and at least two arcuate brackets movably joined to the carriage. The rollers are designed to be capable of bending easily in any direction and have high torsional stiffness and low bending stiffness. One end of each roller is rotatably fastened to the carriage and is connected by a spindle to the rotation actuator. The other end of each roller is rotatably fastened to the free end of an arcuate bracket. The brackets are mounted on the carriage with a distance therebetween sufficient to accommodate the cross-section of the article to be treated. The brackets are capable of rotating towards one another in a mutually perpendicular manner and of enclosing the cross-section of the cylindrical article in a semi-circular manner. The technical result of the invention is increased efficiency, a sim-
(Continued)

plified design, reduced dimensions and greater functional capabilities.

17 Claims, 3 Drawing Sheets

(51) Int. Cl.
*B05C 5/02* (2006.01)
*B05C 1/10* (2006.01)

(52) U.S. Cl.
CPC ..... *B05C 5/0241* (2013.01); *Y10S 118/11* (2013.01); *Y10S 118/13* (2013.01)

(58) Field of Classification Search
USPC ..... 118/205, 264, 266, 268
See application file for complete search history.

APPARATUS FOR APPLYING A COATING TO THE SURFACE OF CYLINDRICAL ARTICLES

BACKGROUND OF THE INVENTION

Field of the Invention

The invention relates to apparatuses for treating the external surface of cylindrical articles, for example, pipes, during the construction and reconstruction thereof, and can be used for applying a coating to the surface of cylindrical articles, in particular, for applying liquid substances—varnishes, paints, glues, solvents and bitumen-based coatings, etc. Furthermore, the cylindrical article can have a definitive length, or can be part of a pipe.

Description of the Related Art

Various devices are known that are used for coating the surface of cylindrical articles.

A known device for applying coating to the pipes containing a reservoir for liquid substances mounted on tapered rollers, where its working member is in the form of interconnected sidewall split rings with porous elements circumferentially encompassing the painted pipe joined by the branch pipe with a reservoir for coloring liquid. (USSR Inventor's Certificate No 902851 for the invention "Device for painting pipes", MPK B05C1/06, pub. Feb. 7, 1982). The device is characterized by cumbersome and not fit for painting pipelines closely located to the facades of buildings or placed close parallel pipelines or pipelines located in difficult access areas.

A known device for painting of lengthy cylindrical products containing the working member, which is a detachable cylindrical frame mounted on painted article bearing paint-coating members, with inlet and outlet ports for paint and detachable sealing rings mounted on the ends of the cylindrical frame (Patent RU No 2 182853 for invention "Apparatus for painting cables of suspension bridges", MPK B 05 C 3/12, pub. May 27, 2002). This known device is also characterized by cumbersome and not fit for processing pipelines located in places of difficult access.

Closest known the essential features and chosen as the prototype device for coating the surface of the cylindrical article, comprising: a detachable coating member comprising two rotating rollers which can congruently annularly encompass the periphery of a cylindrical article to be treated; a mechanism for detaching the coating member; a system for feeding the coating material into coating member. Each of the rollers is formed with an internal cavity and the walls permeable for the covering material, where said rollers providing a flow of coating material from the inner cavity of the roller on the processing surface, and has a passage for supplying the coating material into the inner cavity. Rollers made concave to reach around the pipe and fixed on the axes. The axis of one roller is rigidly secured on the holder, the axis of other roller—with the possibility of translational movement along the holder. A system of feeding the coating material into coating member comprising: a connected to the holder tank for coating material and pump for feeding the latter. (Inventor's Certificate No 1321479 for the invention "Apparatus for painting the pipes", MPK B 05 C 17/02, pub. Jul. 7, 1987). The disadvantage of this device is the lack of degrees of freedom of the working member, which prevents its use for the treatment of pipelines at locations of a bend, and low productivity due to the need to manually move the working member along the treated surface. Furthermore, the device is also cumbersome and time consuming to manufacture.

SUMMARY OF THE INVENTION

The problem addressed by the claimed invention is that of creating a compact apparatus for applying a coating to the surface of pipes, the apparatus having improved technical characteristics and extended functional possibilities.

The technical results achieved as a result of carrying out the claimed invention consist in increasing efficiency of the apparatus, in simplifying the design and reducing the overall dimensions of the apparatus, and also in extending the functional possibilities, in particular by providing for the possibility of applying a coating to the surface of a cylindrical article at locations of a bend and at locations at which access is difficult, including when pipes are arranged at a close distance to facades of buildings or of other surfaces.

The technical results of the claimed invention achieved via offered apparatus for applying a coating to the surfaces of cylindrical articles which comprises: a detaching coating member comprising at least two rotating rollers having ability congruently annularly encompass the periphery of a cylindrical article to be treated; mechanism for detaching the coating member; a system for feeding the coating material into coating member. Each of the rollers is formed with an internal cavity and the walls are permeated by the coating material, where said rollers provide a flow of coating material from the inner cavity of the roller onto the treated surface, and have a passage for supplying the coating material into the inner cavity. The apparatus for applying a coating additionally comprises a roller rotary actuator, a carriage and at least two arcuate brackets movably joined to the carriage. The rollers are designed to be capable of bending easily in any direction and have high torsional stiffness and low bending stiffness. One end of each roller is rotatably fastened to the carriage and is connected by means of a spindle to the rotary actuator. The other end of each roller is rotatably fastened to the free end of an arcuate bracket. The brackets are mounted on the carriage with a distance therebetween sufficient to accommodate the cross-section of the article to be treated. The brackets are capable of rotating towards one another in a mutually perpendicular manner and of enclosing the cross-section of the cylindrical article in a semi-circular manner.

Preferably, in the open state of coating member arcs of the brackets were oriented vertically along the cylindrical article, convex toward each other, and in the closed state—oriented horizontally across the cylindrical article, convex upwards.

Preferably, the actuator be a reverse actuator, contains thermal or electrical or pneumatic or hydraulic motor and provided mutually opposite direction of rotation of rollers, where rollers were oppositely placed about the transverse axis of the cylindrical article.

It is also preferred that the mechanism for detaching included a system of hinged-lever traction connecting brackets' ends movably coupled to the carriage and ensuring their consistent rotation around the vertical and horizontal axes, connecting means of the coating member in an open and closed position, and remote control of traction system.

In some cases, as a means to perform remote control of traction system can be used mechanical, hydraulic, pneumatic, electrical devices.

In some cases, a wire can be used as a mechanical device for remote control of traction system.

In other cases, a hydraulic cylinder can be used as a hydraulic device for remote control of traction system.

In some cases, a pneumatic cylinder can be used as a pneumatic device for remote control of traction system.

In some cases, an electromagnetic thrust is used as an electrical device for remote control of traction system.

In some cases, the rollers are cores having a fleecy and/or porous coating, made of resilient material and/or wires wound in rows.

In some cases, the device may further comprise a handle attached to the carriage.

Preferably, the device further comprises telescopic arm pivotally attached to the carriage.

Preferably, the brackets are mounted on the carriage with the possibility to change the distance therebetween depending on the diameter of the cylindrical articles being treated.

It is also preferred that the feeding system of the coating material into coating member contained actuators providing supplying the coating material under pressure into the coating member.

In some cases, implementation of coating member may include three rotating rollers which being able congruently annularly encompass the periphery of a cylindrical article to be treated, and the three arc-shaped brackets movably joined with the carriage, where the enfold of cylindrical article carried on the one side—by the two rollers, on the other side—by one roller.

Preferably, in the open position of the coating member arcs of the brackets are oriented vertically along the cylindrical article, convex toward each other, when in the closed position oriented horizontally across the cylindrical article, convex upwards; rotary actuator be a reversible, contains thermal or electric or pneumatic or hydraulic motor and provided mutually opposite direction of rotation of rollers, oppositely placed about the transverse axis of the cylindrical article; mechanism for detaching including a system of hinged-lever traction connecting brackets' ends movably coupled to the carriage, and ensuring their consistent rotation around the vertical and horizontal axes, connecting means of the coating member in an open and closed position and means for remote control of traction system; the rollers are cores having a fleecy and/or porous coating, made of resilient material and/or wires wound in rows; apparatus further comprises a handle attached to the carriage and/or a telescopic rod pivotally attached to the carriage; brackets are mounted on the carriage with the possibility of varying the distance therebetween depending on the diameter of the treated cylindrical article; feeding system of the coating material has actuators, which provide supply of the coating material under pressure into coating member; thus it is also preferable that the coating member including three rotating rollers being able congruently annularly encompass the periphery of a cylindrical article to be treated, and the three arc-shaped brackets movably joined to the carriage, where the enfold of the cylindrical article performed with two rollers on one side and with one roller on the other side.

Comparative analysis of the claimed invention with the prior art showed that in all cases the implementation is different from the well-known closest technical solution:

- the presence of the rollers' rotary actuator;
- the presence of the carriage;
- having at least two arcuate brackets movably coupled to the carriage;
- implementation of the rollers as easily be bent in any direction of flexible shafts, having great torsional stiffness and low bending;
- designing rollers at the one end fixed, rotatably mounted on the carriage and through the axis connected to a rotary actuator; where the other end—is rotatably free to rotate at the end of the arcuate arm;
- implementation of the brackets placed on the carriage at a distance, sufficient to accommodate therebetween a cylindrical cross-section of the treated article;
- implementation of the brackets with the possibility of mutually perpendicular pivot towards each other and the semicircular transverse enfold of the cylindrical articles.

In some cases, implementation of the claimed invention differs from known closest technical solution:

- implementation of arcs of the brackets in the open state of the coating member oriented vertically along the cylindrical article; when closed—oriented horizontally across the cylindrical article, concave upwards;
- designing the rotary drive reversible, containing thermal or electric or pneumatic or hydraulic motor and providing mutually opposite direction of rotation of rollers, oppositely placed about the transverse axis of the cylindrical article;
- designing the mechanism for detaching comprising: hinged-lever traction system connecting the brackets' ends movably coupled to the carriage and ensuring their consistent rotation around the vertical and horizontal axes; connecting means of the coating member in an open and closed position; means of remote control of traction system;
- use as a remote control of traction system mechanical, hydraulic, pneumatic and/or electrical devices;
- using a rope as a mechanical device for remote control of traction system;
- using a hydraulic cylinder as hydraulic tool for remote control of the traction system;
- using a pneumatic cylinder as pneumatic device for remote control of traction system;
- using electromagnetic traction as an electrical device for remote control of the traction system;
- designing the rollers as cores having a fleecy and/or porous coating, made of resilient material and/or wires wound in rows;
- presence of handle or telescopic arm pivotally attached to the carriage;
- implementation of brackets mounted on the carriage with the possibility of changing the distance therebetween depending on the diameter of the cylindrical treated article;
- designing the coating material feeding system into coating member comprising actuators, which provide supplying a coating material under pressure into the coating member.
- presence in coating member of three rotating rollers which can congruently annularly encompass the periphery of a cylindrical article to be treated, and the three arc-shaped brackets movably joined to carriages; where the enfold of the cylindrical article is carried on one side by two rollers, where on the other side—by one roller.

The presence of a rotary actuator, bound by the axes with rollers of the coating member allows significantly increase the speed of coating, thereby increasing the performance of the device. Availability of carriage with arcuate brackets mounted thereon in which the rollers are fixed; placing brackets at a distance sufficient to accommodate therebetween the cross-section of the cylindrical treated article with the possibility of mutually perpendicular pivot towards each other and semicircular transverse encompass of the periphery of a cylindrical article, designing arcs of the brackets in the open state of the coating member oriented vertically along the cylindrical article; wherein an arcs of at least two brackets directed convex toward each other, when closed—all arcs are oriented horizontally across the cylindrical article, convex upwards. This design allows optimizing spatial construction of a working member, providing a compact device as a whole. These structural features of the device provide the possibility of coating the cylindrical items to which access is difficult, for example, due to the proximity of pipelines to horizontal or vertical surfaces (walls, floors, etc.). Constructing rollers as easily be bent in any direction of flexible shafts, having a large torsional stiffness and low bending, on the one hand eliminates twisting of roller and provides a snug conjugation of coating surface of the roller with the surface of a treated cylindrical article. Thereby increasing the quality of the coating, on the other hand allows to treat not only the straight sections of the pipeline, but also places of the bend, without additional technological operations and technological interruptions, thereby extending the capabilities of the device and increasing its productivity. Using reverse rotary actuator enables reciprocation motion of coating member. Using the hinged-lever traction system connecting brackets' ends movably coupled to the carriage and ensuring their sequential rotation around the vertical and horizontal axes; availability of connecting means of the coating member in the open and closed state, and also the means of remote control of traction system provides high performance and reliability of the mechanism of detaching the coating member. The presence of the handle improves the usability of the device, and the presence of a carriage pivotally secured to the telescopic arm extends the functionality of the device, allowing treating cylindrical articles, e.g., piping, located at a considerable height from the ground. Installation of brackets with the possibility of changing the distance between them depending on the diameter of the treated cylindrical article expands functionality of the device, allowing the same apparatus to be used for a different range of pipe. The presence on the roller fleecy and/or porous shell improves the quality of the coating. Due to the roller core made of a resilient material and/or wire wound in rows provides the flexibility of the roller. Constracting the coating member comprising of three rotating rollers enshrined in the three arc-shaped brackets movably joined to the carriages; with the enfold of the pipe from one side by two rollers, on the other side—by one roller; thus increases the stability of the spatial distribution of the coating member with respect to the treated pipe, eliminating possible distortions.

BRIEF DESCRIPTION OF THE DRAWINGS

The present invention is illustrated by the drawings shown in FIGS. 1, 2, 3.

DESCRIPTION OF THE PREFERRED EMBODIMENTS

Figure 1:
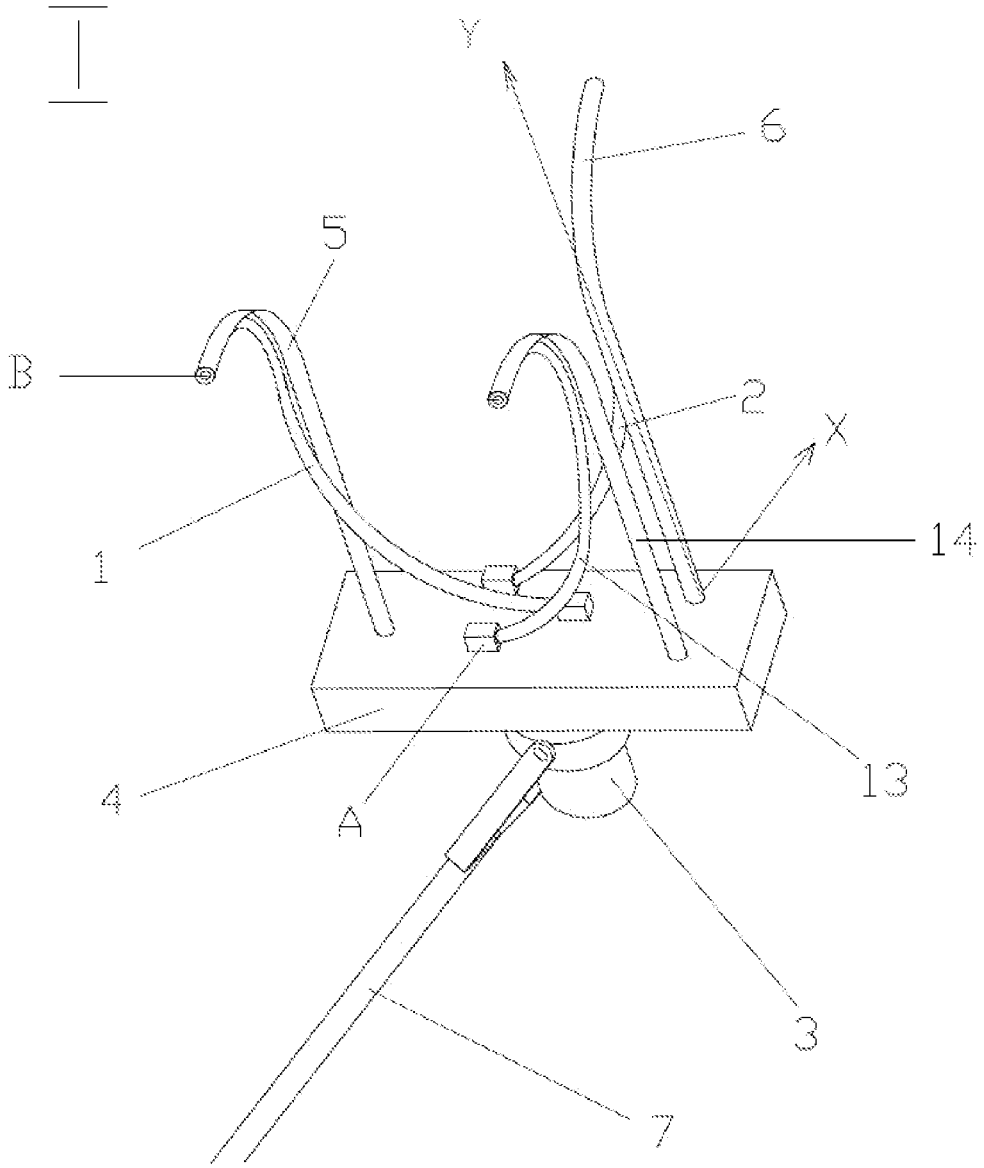
FIG. 1 shows a drawing of an apparatus for applying a coating to the surface of cylindrical articles in the open (non-operating) state.
Figure 2:
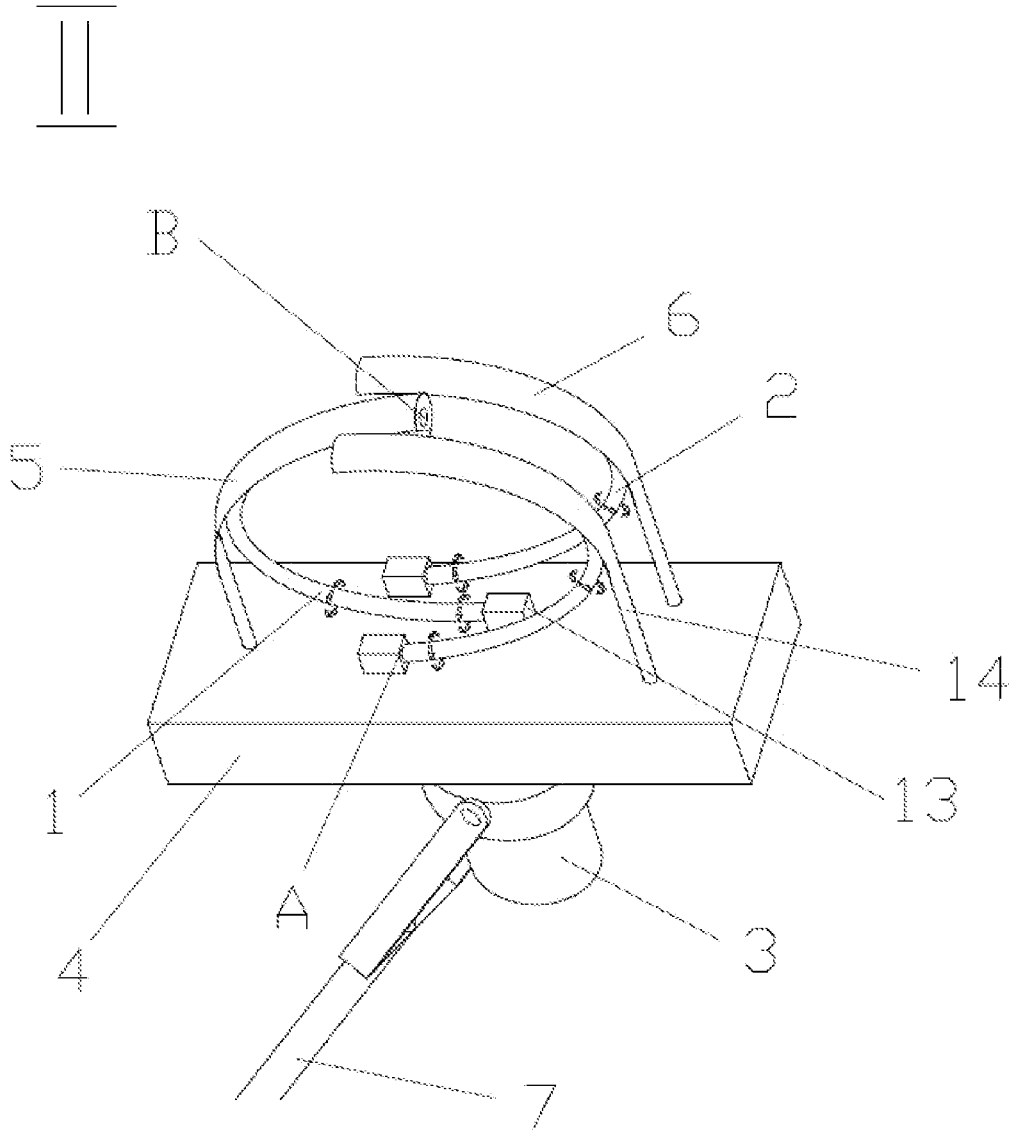
FIG. 2 shows a drawing of an apparatus for applying a coating to the surface of cylindrical articles in the closed (operating) state.
Figure 3:
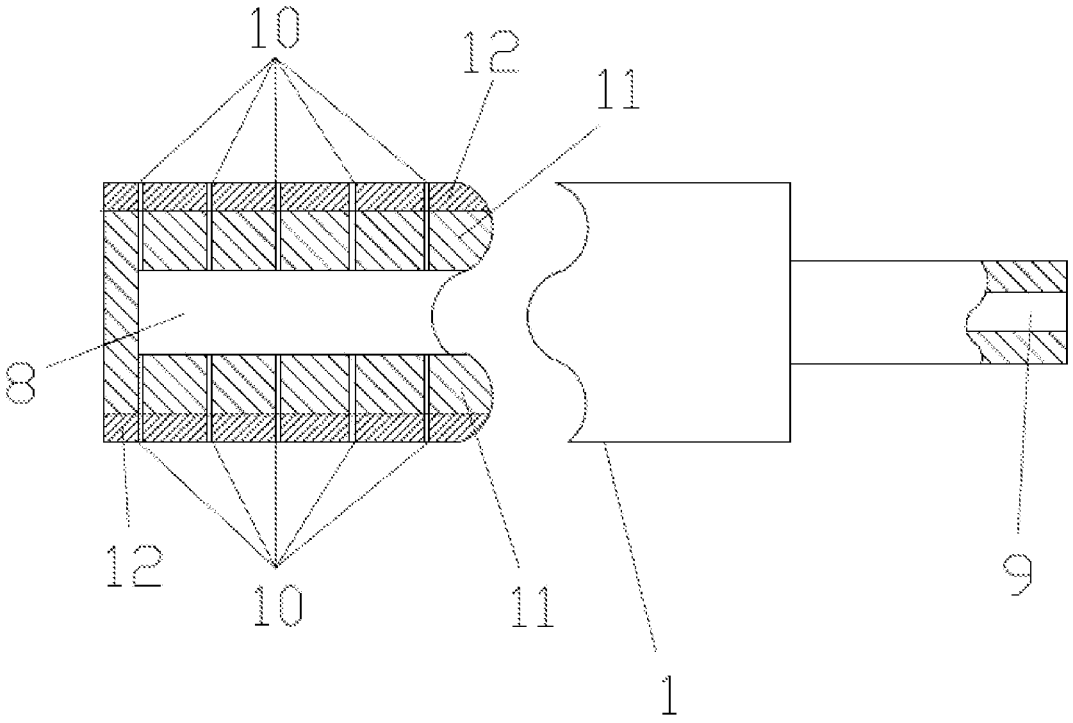
FIG. 3 shows a drawing of a roller of the coating member of apparatus for applying a coating to the surface of cylindrical articles.

In a preferred embodiment apparatus for applying a coating to the surface of cylindrical articles comprises: detachable coating member comprising at least two rotatable rollers 1, 2; a roller rotation actuator 3; carriage 4 and at least two arcuate brackets 5, 6, movably joined to the carriage 4; telescoping pole 7, is pivotally attached to the carriage 4, or handle (not shown); a mechanism for detaching the coating member and feeding system in its of a coating material (not shown). The rollers 1 and 2 are designed to be capable of bending easily in any direction of flexible shafts and have high torsional stiffness and low bending stiffness and comprise an inner cavity 8, the duct 9 for supplying the coating material. The rollers 1, 2 having walls permeable to the coating material, ensure delivery the latter from the inner cavity of the roller to the treated surface for example through the holes 10. One end (A) of each of the rolls 1, 2 is rotatably mounted, for example, in bearing units (not shown) on the carriage 4 and through the axis (not shown) is connected to the rotary actuator 3. The other end (B) of each roller 1, 2 is rotatably mounted, for example, in bearing units (not shown) in an open ends of arcuate brackets 5, 6. The brackets 5, 6 are mounted on the carriage 4 at a distance somewhat exceeding the diameter of the treated cylindrical article and at the distance sufficient to accommodate its cross section between the brackets. The brackets 5, 6 movably joined with the carriage 4 by means of swivel (not shown), providing an opportunity of mutually perpendicular rotation of brackets 5, 6 toward each other from the disconnected state I (coating member shall be open) into operating status II with the semi-circular transverse enfold of the pipe (coating member is closed). When you open state the coating member (I) arcs of the brackets 5, 6 are oriented vertically along the pipe, convex toward each other, when closed (II)—oriented horizontally across the pipe, convex upwards. Rotary actuator 3 provides mutually opposite directions of rotation of rollers 1, 2 oppositely placed with respect to the cylindrical article; it contains a reversible motor, in which can be used the thermal, electric, pneumatic or hydraulic motor (not shown). Detachment and connection of the coating member provides by mechanism, which is comprising: a system of hinged lever linkage (not shown), which connecting the end of the brackets 5, 6, movably associated with the carriage and ensuring their consistent rotation around the vertical (y) and horizontal (x) axes; connection means of the coating member in an open and closed state and means of remote control of the traction system, as which may be used wire and/or hydrocylinder and/or pneumatic cylinder and/or the electromagnetic traction (not shown). The rollers 1, 2 may have a core 11 of resilient material and/or rows of wound wire having a fleecy and/or porous coating 12. The brackets 5, 6 may be mounted on the carriage 4 with the possibility of varying the distance therebetween depending on the diameter of the cylindrical treated article (not shown). A coating material feeding system toward coating member comprises mechanisms, which provide feeding of the coating material under pressure into the coating member, including a container with coating material, a flexible hose for feeding a coating material into the coating member, the priming pump (not shown). In some cases of implementation coating member may include optional rotating roller 13 adapted to congruently annularly encompass the periphery of a cylindrical article to be treated, and additional arcuate bracket 14 movably coupled to the carriage 4. Brackets with rollers are mounted so that enfold of the pipe on one side is provide by the roller (1), where on the other side by two rollers—(2, 13). When in open state of the coating member (I) arcs of the brackets 5, 6, 14 oriented vertically along the pipe, where the convex of pairs of brackets 5, 6, as well as the brackets 5, 14 face each other; when in the closed (state II)—are aligned horizontally across the pipe, convex upwards.

INDUSTRIAL APPLICATION

Claimed apparatus operates as follows. Treated cylindrical articles disposed between the brackets 5 and 6 or between the brackets 5 and 6, 14. With help of mechanism of detachment and connection (not shown) the brackets 5 and 6 are rotated first around the vertical axis y, thereby providing mutually perpendicular turning towards each other and then—about a horizontal axis x, providing the semi-circular transverse enfold of the treating article. And then made a turn of the arcuate bracket 14 with the roller 13 (if available), first around a vertical axis y, then the horizontal axis x. In this, flexible rollers 1, 2, 13 tightly grip the treated pipe by its periphery providing congruent pairing of the coating surface of the latter with an outer surface of the treated pipe. Closed (working) position II of the coating member connected by the connecting means (not shown) prevent unauthorized opening of the latter. Rotary actuator 3 provides synchronous rotation in the opposite direction of the oppositely arranged rollers 1 and 2 or 1 and 2, 13, providing translational motion of the coating member along the treated pipe. When the engine is switched into reverse mode, direction of motion of the coating member is reversed. The coating material is fed under pressure from a compressed air tank through a flexible hose (not shown), through the channel 9 into the internal cavity 7 of the rolls 1, 2, 13 and through holes 10 supplied to the treated surface of the pipe. Upon rotation rollers 1, 2, 13 are bent, wherein the curvature of its working surface coincides with the curvature of the cylindrical article to be coated. During rotation of the roller around its axis, as it is made of resilient material and its axis of rotation maintains a curvilinear shape, layers of the working sheath of the roller cyclically compressed and stretched depending on which side of the roller they are (convex or concave), providing a uniform coating on the pipe's surface. After coating, the working member is opens and releases the pipe. The inventive design is simple, lightweight, compact and economical.

The invention claimed is:

1. An apparatus for coating the surface of cylindrical articles comprising: a detachable coating member comprising at least two rotating rollers which can congruently annularly encompass the periphery of a cylindrical article to be treated; a mechanism for detaching the coating member; a feeding system of the coating material into coating member, wherein each of the rollers are executed with an inner cavity and its walls are permeable to the coating material, providing delivery of the latter from the inner cavity of the roller onto the treated surface, and has a channel for feeding coating material into the inner cavity, in that it further comprises a rollers rotation actuator; a carriage and at least two arcuate brackets movably joined to the carriage; the rollers are designed to be capable of bending easily in any direction and to have high torsional stiffness and low bending stiffness, where one end of each roller is rotatably fastened to the carriage and is connected by a spindle to the rotary actuator, the other end of each roller is rotatably fastened to a free end of an arcuate bracket; the brackets are mounted on the carriage with a distance therebetween sufficient to accommodate the cross-section of the article to be treated and are capable of rotating towards one another in a mutually perpendicular manner and capable of enclosing the cross-section of the cylindrical article in a semi-circular manner.

2. The apparatus according to claim 1, wherein in an open state of the coating member arcs of the brackets oriented vertically along the cylindrical article, where the convex of pairs of brackets face each other; when in a closed state they are aligned horizontally across the cylindrical article, convex upwards.

3. The apparatus according to claim 1, wherein rotary actuator is reversible; it contains thermal or electrical or pneumatic or hydraulic motor and provides mutually opposite direction of rotation of the rollers, where the rollers are oppositely placed about the transverse axis of the cylindrical article.

4. The apparatus according to claim 1, wherein the mechanism for detaching includes a system of hinged-lever traction connecting brackets' ends movably coupled to the carriage and ensuring their consistent rotation around the vertical and horizontal axes, connecting the coating member in an open and closed state, and remote control of traction system.

5. The apparatus according to claim 4, wherein remote control of traction system can be used mechanical and/or hydraulic and/or pneumatic and/or electrical devices.

6. The apparatus according to claim 5, wherein a wire is used as a mechanical device for remote control of traction system.

7. The apparatus according to claim 5, wherein a hydraulic cylinder is used as a hydraulic device for remote control of traction system.

8. The apparatus according to claim 5, wherein a pneumatic cylinder is used as a pneumatic device for remote control of traction system.

9. The apparatus according to claim 5, wherein an electromagnetic thrust is used as an electrical device for remote control of traction system.

10. The apparatus according to claim 1, wherein the rollers are cores having a fleecy and/or porous coating, made of resilient material and/or wires wound in rows.

11. The apparatus according to claim 1, wherein apparatus further comprise a handle attached to the carriage.

12. The apparatus according to claim 1, wherein apparatus further comprise a telescopic rod pivotally attached to the carriage.

13. The apparatus according to claim 1, wherein the brackets are mounted on the carriage with the possibility to change the distance therebetween depending on the diameter of the cylindrical articles being treated.

14. The apparatus according to claim 1, wherein the feeding system of the coating material into coating member contains actuators that provide the supply of the coating material under pressure into the coating member.

15. The apparatus according to claim 1, wherein the coating member includes three rotating rollers being able congruently annularly encompass the periphery of a cylindrical article to be treated, and three arc-shaped brackets are movably joined with the carriage, where the enfold of the cylindrical article is performed with two rollers on one side and with one roller on the other side.

16. The apparatus according to claim 1, wherein in an open position of the coating member arcs of the brackets are oriented vertically along the cylindrical article, convex toward each other and when in a closed position oriented horizontally across the cylindrical article, convex upwards; rotary actuator is reversible, contains thermal or electric or pneumatic or hydraulic motor and provides mutually opposite direction of rotation of the rollers, oppositely placed about the transverse axis of the cylindrical article; the mechanism for detaching including a system of hinged-lever traction, connecting the brackets' ends movably coupled to the carriage, and ensuring their consistent rotation around the vertical and horizontal axes, connecting the coating member in open and closed positions and remote control of traction system; the rollers are cores having a fleecy and/or porous coating, made of resilient material and/or wires wound in rows; apparatus further comprises a handle attached to the carriage and/or a telescopic rod pivotally attached to the carriage; said brackets are mounted on the carriage with the possibility of varying the distance therebetween depending on the diameter of the treated cylindrical article; the feeding system of the coating material has actuators which provide supply of the coating material under pressure into coating member.

17. The apparatus according to claim 16, wherein the coating member including three rotating rollers being able congruently annularly encompass the periphery of a cylindrical article to be treated, and the three arc-shaped brackets movably joined to the carriage, where the enfold of the cylindrical article is performed with two rollers on one side and with one roller on the other side.

* * * * *